United States Patent [19]

Schefer

[11] Patent Number: 4,826,014

[45] Date of Patent: May 2, 1989

[54] COMPACT CASE WITH INTERCHANGEABLE COSMETIC INSERTS

[75] Inventor: Eli I. Schefer, Sands Point, N.Y.

[73] Assignee: Revlon, Inc., New York, N.Y.

[21] Appl. No.: 205,502

[22] Filed: Jun. 7, 1988

Related U.S. Application Data

[63] Continuation of Ser. No. 96,237, Sep. 8, 1987, abandoned, Continuation of Ser. No. 819,978, Jan. 14, 1986, abandoned, Continuation of Ser. No. 639,282, Aug. 9, 1984, abandoned, Continuation-in-part of Ser. No. 416,800, Sep. 13, 1982, Pat. No. D. 280,450.

[51] Int. Cl.[4] ..... B65D 69/00

[52] U.S. Cl. ..... 206/581; 206/235; 206/815; 206/823; 220/DIG. 26; 132/294; 132/303

[58] Field of Search ..... 206/1.7, 1.8, 1.9, 37, 206/38, 235, 581, 815, 823; 220/DIG. 26; 132/82 C, 82 D, 82 F, 82 J, 83 G, 83 R

[56] References Cited

U.S. PATENT DOCUMENTS

| | | | |
|---|---|---|---|
| 1,345,357 | 7/1920 | Goertz et al. | 206/37 R |
| 1,498,822 | 6/1924 | Turnquist | 132/83 R |
| 1,572,850 | 2/1926 | Slaiger . | |
| 1,592,136 | 7/1926 | Davis | 132/83 R |
| 1,601,892 | 10/1926 | Thralls | 132/83 R |
| 1,682,534 | 8/1928 | Martinat | 132/83 R |
| 1,715,820 | 6/1929 | Deitel . | |
| 1,743,611 | 1/1930 | Larson . | |
| 1,767,567 | 6/1930 | Weil . | |
| 1,774,543 | 9/1930 | Babbitt . | |
| 1,836,722 | 12/1931 | Morrison | 132/83 R |
| 1,838,697 | 12/1931 | McAtree . | |
| 1,959,629 | 5/1934 | Kasdan et al. | 220/DIG. 26 |
| 2,031,933 | 2/1936 | Clegg . | |
| 2,035,356 | 3/1936 | White et al. . | |
| 2,196,017 | 4/1940 | Kane . | |
| 2,196,801 | 4/1940 | Kreisler | 206/823 |
| 2,233,859 | 3/1941 | Wick . | |
| 2,314,717 | 3/1943 | Landwehr . | |
| 2,355,143 | 12/1944 | Emery . | |
| 2,526,596 | 10/1950 | Williamson | 206/823 |
| 2,533,618 | 12/1950 | Pinanski . | |
| 2,628,625 | 2/1953 | Pike . | |
| 2,712,318 | 7/1955 | Root | 132/83 R |
| 2,734,517 | 2/1956 | Ferraro | 132/83 R |
| 2,806,312 | 9/1957 | Grumbacher | 206/1.7 |
| 2,823,681 | 2/1958 | Miller . | |
| 2,851,041 | 9/1958 | Grosso . | |
| 2,997,168 | 8/1961 | Tall | 206/815 |
| 3,278,007 | 10/1966 | Weber . | |
| 3,592,201 | 7/1971 | Haddaway . | |
| 3,637,278 | 1/1972 | Easterbrooks . | |
| 3,698,594 | 10/1972 | Bochlert | 206/815 |
| 4,132,306 | 1/1979 | Margolin | 132/79 C |
| 4,236,560 | 2/1980 | Reischauer | 206/37 |
| 4,337,859 | 7/1982 | Murphy et al. . | |
| 4,369,799 | 1/1983 | Napoleon | 132/83 R |
| 4,421,127 | 12/1983 | Geer | 206/235 |

FOREIGN PATENT DOCUMENTS

| | | | |
|---|---|---|---|
| 106517 | 2/1939 | Australia | 206/1.8 |
| 376875 | 5/1931 | United Kingdom . | |
| 753647 | 7/1956 | United Kingdom | 132/83 R |
| 764125 | 12/1956 | United Kingdom | 132/83 R |

*Primary Examiner*—David T. Fidei
*Attorney, Agent, or Firm*—Wigman & Cohen

[57] ABSTRACT

A compact case includes a top cover, a bottom support tray, and an intermediate lid positioned between the top cover and support tray, all being hinged together for relative movement with respect to one another, the support tray including a matrix configuration of ribs defining areas to accept the cosmetic inserts while the lid defines openings corresponding to the matrix configuration. The cosmetic inserts contain cosmetic materials and are removably positioned in selected ones of the areas. The openings in the lid register with the cosmetic inserts in the compact case.

10 Claims, 3 Drawing Sheets

Fig. 5.
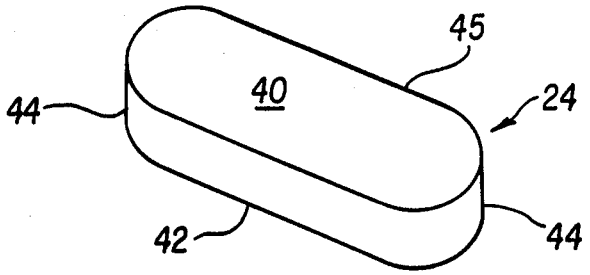
Fig. 9
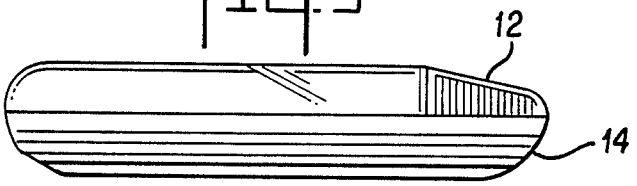
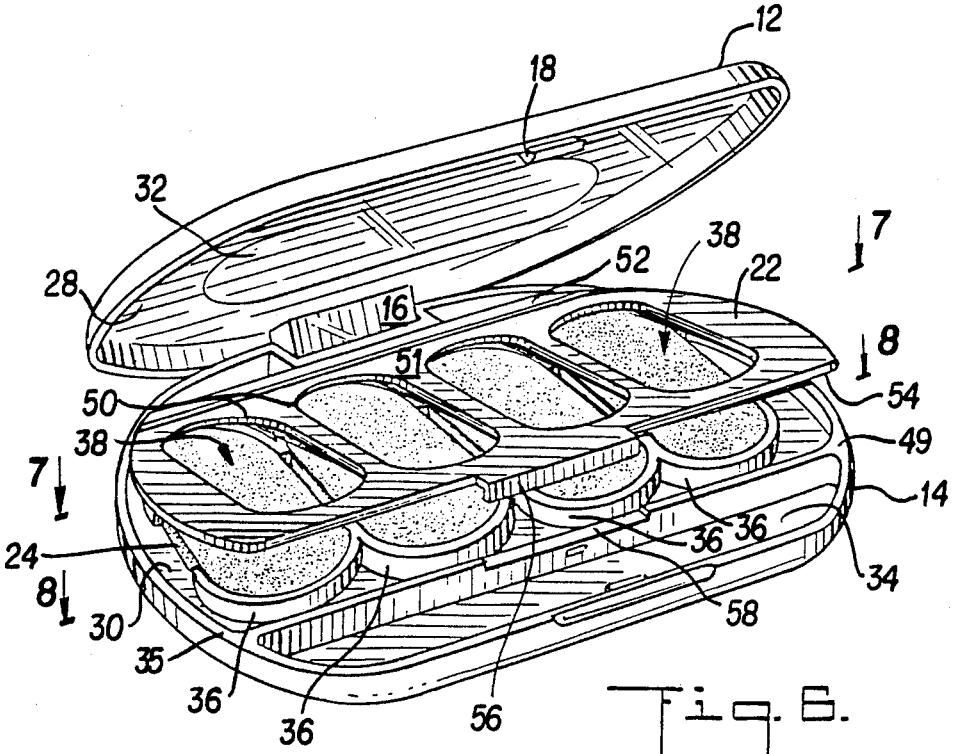
Fig. 6.

COMPACT CASE WITH INTERCHANGEABLE COSMETIC INSERTS

This is a continuation of co-pending application Ser. No. 096,237 filed on Sept. 8, 1987 and as listed in Preliminary Amendment filed 9/8/87 which is a continuation of application Ser. No. 819,978, filed Jan. 14, 1986, now abandoned, which was a continuation of Ser. No. 639,282, filed Aug. 9, 1984, now abandoned, which was a continuation-in-part of application Ser. No. 416,800 filed Sept. 13, 1982, now U.S. Pat. Des. No. 280,450 issued on Sept. 3, 1985.

BACKGROUND OF THE INVENTION

The present invention generally relates to a novel and improved case for housing, in palette form, a plurality of individual cosmetic containers. A case of the type with which the present invention is concerned is generally recognized in the art as a "compact" case. More particularly, however, the present invention relates to an improved compact case wherein removable inserts, each containing a predetermined shade and/or type of cosmetic, can be securely held in place thereby providing the user with a variety of cosmetic materials from which to choose.

The reader will appreciate that cosmetic materials offered to the consumer are too numerous in variety to name each one separately herein. Suffice it to say, however, that the particular cosmetic assortment which an individual consumer purchases is entirely dependent upon that consumer's subjective preferences. The reader will also appreciate that a consumer normally desires an assortment of cosmetics which includes the desired color hues to accent and complement that consumer's particular skin, hair color, facial characteristics, or even, wardrobe. Additionally, various types of cosmetics may be desirable, for example, eye shadow, mascara, foundations, blush, lip gloss or the like.

Heretofore, when a consumer desired to purchase an assortment of cosmetics in a single package, manufacturers would often present a palette of preselected, fixed containers of cosmetic materials having a variety of both colors and types. However, as has been briefly noted, it was highly unlikely that each consumer would subjectively approve of the manufacturer's preselected assortment. Consequently, the consumer would use only those cosmetics which met with their approval and therefore would waste those cosmetics which did not. This, of course, was costly to the consumer since the unused and wasted cosmetics were purchased together with desired cosmetics.

My invention, therefore, is intended to alleviate such wasteful practices and to ensure that consumers will have at their disposal a complete array of desired cosmetics. To accomplish this advantageous result, I provide a cosmetic compact case wherein a matrix configuration is provided to accept a plurality of individual removable cosmetic inserts so as to establish a cosmetic palette. In order to securely hold the inserts in their predetermined matrix position, I provide a hinged locking intermediate lid which defines a plurality of openings corresponding in number and position to the matrix configuration. The openings register with corresponding ones of the inserts so as to restrain them from inadvertant movement inside the compact case while, at the same time, permitting free access to all cosmetics contained in each of the inserts comprising the matrix.

It is entirely conceivable, therefore, that the individual cosmetic inserts can be offered to the consumer independent of the compact case of the present invention into which they will be positioned. Thus, consumers will now be able to choose only those preferred cosmetics which are desirable for purchase and assemble them in a compact case so as to establish a personal and unique arrangement of cosmetics. Furthermore, the novel compact case of the present invention can be provided with any combination of desired matrix configurations so that the quantity and variety of cosmetics which a consumer can have in an organized fashion is limited only in a practical sense by the resulting size thereof.

Accordingly, the consumer can now own a variety of cosmetics enclosed in one container for home use, yet be able to select only those cosmetics for carrying in a pocket or purse by removing the desired cosmetics inserts from the larger home-use case and placing them in a smaller, more portable version of the case. In each instance, the cosmetic inserts are identical in size and geometric configuration thereby promoting free interchangeability and versatility among compact cases having various matrix arrangements.

These and other advantages of the present invention will become more clear to the reader after careful consideration is given to the detailed description of the preferred exemplary embodiment thereof which follows.

BRIEF DESCRIPTION OF THE DRAWINGS

FIG. 5 is a perspective view of a cosmetic insert;

FIG. 6 is a front-side perspective view showing the top and shield in open positions;

FIG. 9 is a side elevational view of the side shown in FIG. 1.

DETAILED DESCRIPTION OF THE INVENTION

Figure 1:
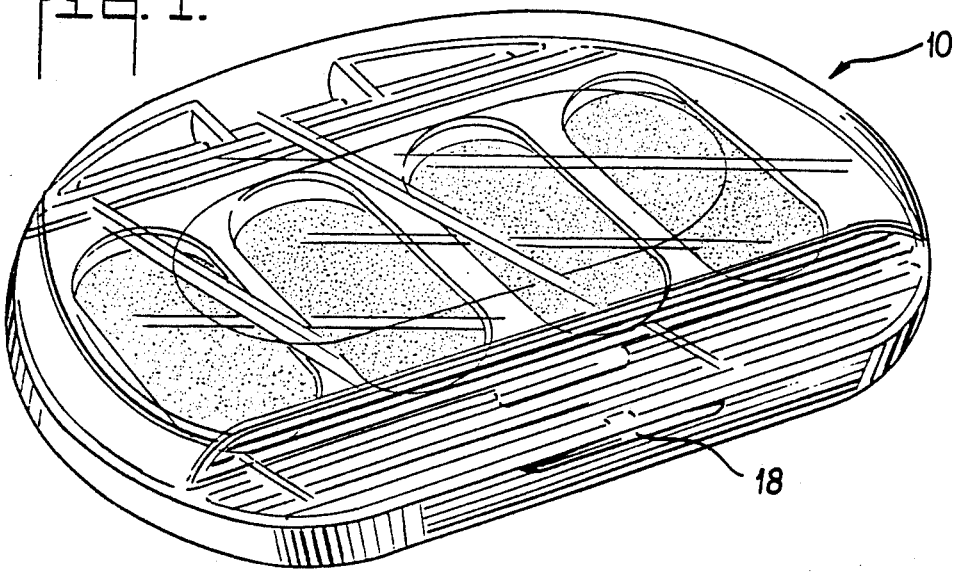
FIG. 1 is a front-side perspective view of one embodiment of the cosmetic compact.
Figure 2:
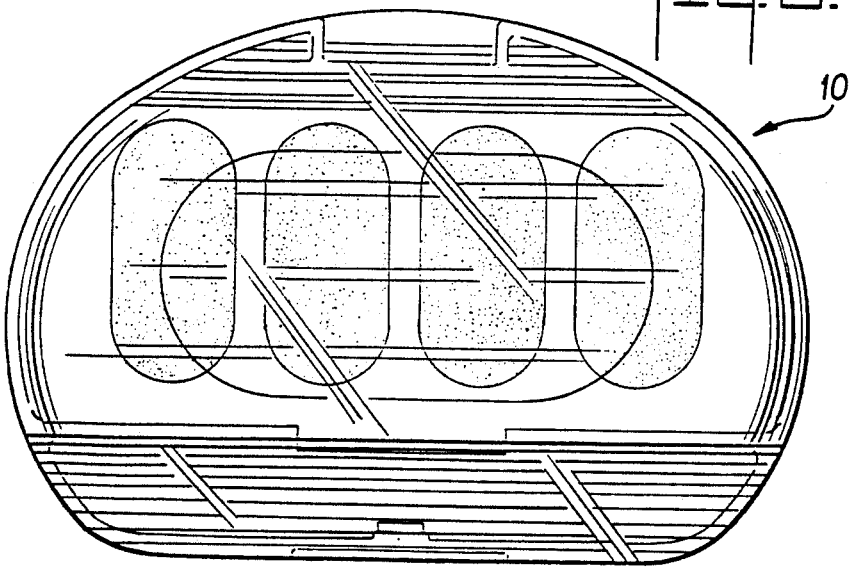
FIG. 2 is a top plan view thereof.
Figure 3:
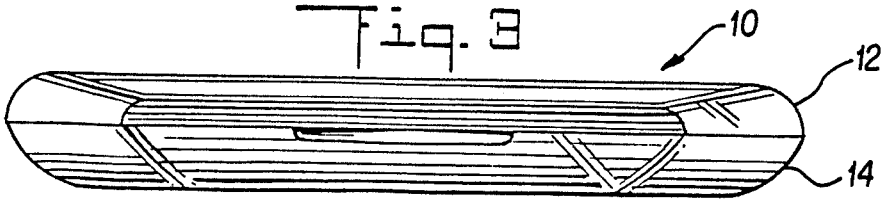
FIG. 3 is a front elevational view thereof.
Figure 4:
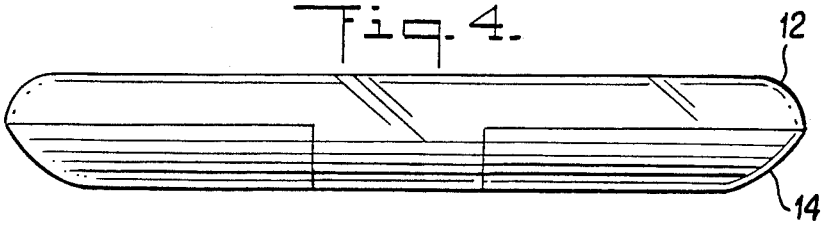
FIG. 4 is a back elevational view thereof.
Figure 7:
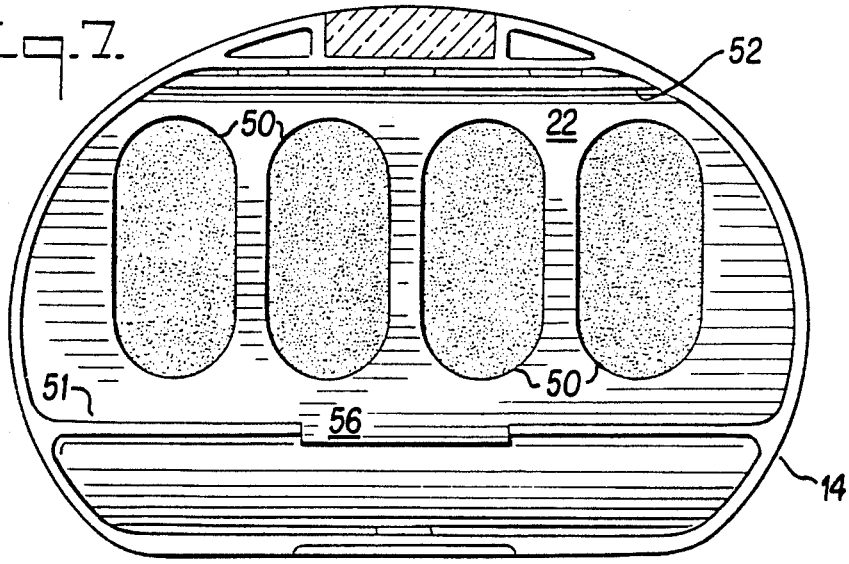
FIG. 7 is a cross-sectional view along line 7—7 of FIG. 6.
Figure 8:
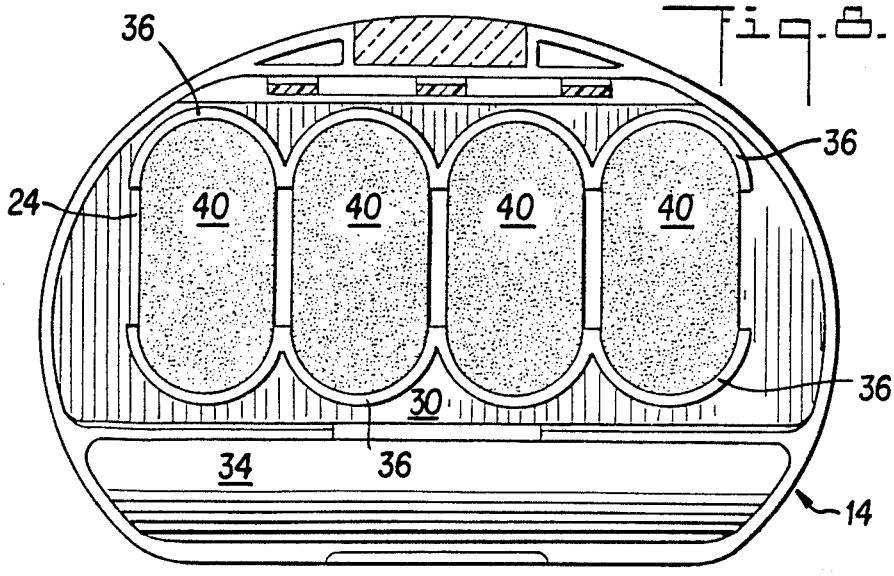
FIG. 8 is a cross-sectional view along line 8—8 of FIG. 6.

As depicted in the accompanying drawings with particular attention being directed to FIGS. 6–8, it is seen that the compact case 10 of the present invention generally includes a top cover 12 and a bottom support tray 14 connected to one another for relative pivotal movement by suitable hinge means 16. A clasp 18 or other releasable mechanisms can be provided to effect secure locking engagement of compact case 10 in a closed position (as in FIGS. 1–4 and 9), yet permit case 10 to be opened (see FIG. 6) so as to gain access to the cosmetics contained therein. To enhance the aesthetic appearance of compact case 10, a decorative design can be engraved or embossed on the exterior portion thereof according to known techniques.

An important aspect of the present invention is the provision of an intermediate, substantially planar shield or lid 22 which can be seen with more clarity by referring to FIGS. 6 and 7. Lid 22 cooperates with the interchangeable cosmetic inserts 24 so as to restrain them from movement within case 10 yet permit predetermined ones to be replaced or interchanged as will be described in more detail below.

Top cover 12 and bottom support tray 14 each define on their inner surfaces recesses 28 and 30, respectively, so that when case 10 is closed, a relatively shallow cavity is defined therein. Recess 28 can be provided with a mirror 32 to aid the user in applying the cosmetics housed in case 10. Furthermore, support tray 14 is preferably provided with a second recessed area 34 defined in forward surface 35 to conveniently hold cosmetic applicator brushes (not shown) or like utensils.

Support tray 14 is preferably integrally formed with upstanding ribs 36 disposed in recess 30 and upwardly projecting from the surface thereof (see FIGS. 6 and 8). Ribs 36 are arranged so as to define a predetermined matrix grid-like array of areas 38 into which the individual cosmetic inserts 24 are received, one to each area. The areas 38 and the cosmetic inserts 24 are advantageously identical with respect to one another so as to promote free interchangeability of inserts 24. While the Figures show a compact with four such removable inserts, it will be recognized that two, three, up to six or more inserts can be employed as the manufacturer wishes.

Cosmetic inserts 24 are provided so as to establish a receptacle of cosmetic material 40. Inserts 24, and thus areas 38 defined by ribs 36, can be any geometric shape. While a rectangular shape can maximize the available interior space of case 10, the inserts can be elongated with rounded ends, as shown in FIGS. 6 and 8. They can alternatively be rectangular, elliptical, circular, triangular, or any other shape which the manufacturer believes will appeal to the purchaser.

Referring to FIG. 5, each cosmetic insert 24 includes an integral base 42 having a vertical perimetrical edge 44 dimensioned so as to closely fit against ribs 36 in areas 38. In an alternative embodiment, a neck member (preferably integrally formed with base 42) is interiorly recessed from the perimetrical edge 44 so as to define a horizontal ledge circumferentially extending around the neck member, the purpose of which will become more clear from the discussion below. Edge 44, or the neck member, defines a cavity into which a predetermined amount of cosmetic material 40 can be stored.

In order to securely restrain cosmetic inserts 24 within case 10, I provide lid 22, which has been briefly described above. Lid 22 defines a plurality of openings 50 and is preferably connected to top cover 12 and bottom support tray 14 via hinge means 52 for relative independent hinged movement therewith. Preferably, hinges 52 and 16 are coaxially disposed relative to one another although opposing hinged connections to effect movement through opposing arcs is also conceivable. On the bottom surface 54 of lid 22 at the end generally opposite the hinged end, I provide a dependent catch 56 which cooperates with a corresponding tab 58 defined in surface 35 to permit a press-fitting closure of lid 22 (see FIG. 6). Of course, other locking means can be advantageously utilized, such as a pair of nibs dependent from surface 54 which cooperate with a corresponding pair of apertures defined in surface 35. Lid 22 can be provided with a finger recess to assist the user in opening lid 22 so as to replace or interchange cosmetic inserts 24.

Openings 50 are defined in lid 22 in such a manner that each registers with one cosmetic insert 24 positioned in areas 38 as hereinbefore described. When the inserts 24 comprise pans as shown in FIG. 5, the openings 50 should be dimensioned so that they conform as closely as possible to the shape of the rim 45 defined by edge 44 of the inserts. When inserts 24 are properly positioned in areas 38 and the lid 22 is closed, rim 45 should approach or meet surface 54 to minimize motion of insert 24 normal to the plane of lid 22. Openings 50 can overlap rim 45, by up to a millimeter for instance, to ensure that the insert 24 cannot pass through opening 50 while ensuring that the cosmetic user can reach cosmetic product 40 in all areas of the insert 24. When the inserts 24 are of the type having a ledge and neck member formed in edge 44, then when cosmetic inserts 24 are properly positioned in areas 38, the ledge is substantially coplanar with surface 35 and upper edge 49 of support tray 14. The neck members of each insert 24 will pass through the associated opening 50 and extend a predetermined dimension above the upper surface 51 of lid 22. In such a manner, surface 54 bears against the horizontal ledge of each of the inserts 24 as well as surface 35 so as to maintain the spatial integrity of inserts 24 and restrain movement thereof. Of course, should the user desire to remove predetermined ones of cosmetic inserts 24, all that is necessary is that lid 22 be hingedly moved out of contacting relationship therewith as shown in FIG. 6.

As the reader will now undoubtedly realize, the present invention provides significant advantages over previously proposed compact cases. For example, complete interchangeability of cosmetic inserts is now available due to the present invention so as to permit the consumer to preselect only those cosmetics that are desired. Furthermore, a compact case in accordance with the present invention enables one to carry particular cosmetics on a daily basis even though such cosmetics are different from those utilized during the previous day.

The compact case with interchangeable cosmetic inserts of the present invention can be provided with any predetermined matrix or other configuration. Additionally, the areas defined by the ribs of the present invention can be of varied dimension and/or geometric shape with respect to one another although substantial identity thereamong is presently preferred.

The compact and inserts of the present invention are preferably constructed of a lightweight, substantially rigid material e.g. thermoplastic materials, and can therefore be produced on a mass scale according to techniques well known in the product fabrication art.

Accordingly, while the present invention has been herein described in what is presently conceived to be the most preferred embodiment thereof, those in the relevant art may appreciate that many modifications may be made thereof without departing from the scope of the invention, which scope shall be accorded the broadest interpretation of the appended claims so as to encompass all equivalent structures, devices, and/or assemblies.

What is claimed is:

1. A cosmetic compact comprising:

a top cover;

a base hingedly secured to said top cover at a portion of one edge of said top cover;

a plurality of upstanding ribs extending from the upper surface of said base defining a plurality of spaced areas capable of receiving cosmetic material therein, said upstanding ribs forming a plurality of discontinuously formed semi-cylindrical segments forming oval-shaped spaced areas between corresponding ribs;

an intermediate lid member hingedly positioned between said top cover and said base, said lid member having portions defining oval-shaped openings therein, said openings being of a size and shape slightly smaller than but substantially conforming to the size and shape of said plurality of oval-shaped spaced areas defined by said upstanding ribs, whereby when said lid is in a closed position said lid portions are in a confronting relationship with said upstanding ribs to retain said cosmetic material when said cosmetic material is placed therein, said discontinuously formed semi-cylindrical segments enabling easy insertion and removal of said cosmetic material.

2. The cosmetic compact as defined in claim 1 further including an elongated cavity provided in front of said base and substantially extending the width of said base.

3. The cosmetic compact as defined in claim 1 wherein said top cover includes closure means positioned opposite to said hinge for releasably securing said cover to said base.

4. The cosmetic compact as defined in claim 1 wherein said intermediate lid member is hinged along the same edge as said top cover such that the opening movements of both are the same.

5. The cosmetic compact as defined in claim 4 wherein said intermediate lid further includes releasable closure means opposite to said hinge for securing said lid to said base.

6. The cosmetic compact as defined in claim 5 wherein said base further includes means defining recessed surfaces for receiving a compact applicator therein.

7. The cosmetic compact as defined in claim 6 wherein said compact is of substantially oval shape.

8. The cosmetic compact as defined in claim 1 wherein said top cover includes a mirror on the interior surface thereof.

9. The cosmetic compact as defined in claim 8 further comprising cosmetic material positioned in said spaced areas below said lid openings.

10. The cosmetic compact as defined in claim 9 further including a plurality of pans containing said cosmetic material, said pans being removably positioned in the spaced areas below said lid openings.

* * * * *